United States Patent [19]

Leppänen

[11] Patent Number: 4,708,532

[45] Date of Patent: Nov. 24, 1987

[54] APPARATUS FOR STORING A CONCRETE FEEDING HOSE IN A ROCK BOLTING DEVICE

[75] Inventor: Jarmo Leppänen, Ylöjärvi, Finland

[73] Assignee: Oy Tampella Ab, Tampere, Finland

[21] Appl. No.: 925,567

[22] Filed: Oct. 31, 1986

[30] Foreign Application Priority Data

Nov. 7, 1985 [FI] Finland ..... 854382

[51] Int. Cl.[4] ..... E21D 20/02

[52] U.S. Cl. ..... 405/303; 401/261; 401/265; 137/355.12; 137/355.16; 141/367; 141/387; 222/530; 226/196; 242/86.5 R; 242/54 A; 264/31; 425/59; 425/64; 405/260; 405/269

[58] Field of Search ..... 405/259, 260, 261, 303, 405/269; 137/355.12–355.28; 425/59, 63, 64, 87, 90, 110, 256; 264/31; 222/527, 529, 530, 320, 321; 141/279, 387, 388, 389, 367; 242/86, 86.2, 86.5 R, 54 A; 226/196, 199, 176; 401/261, 265

[56] References Cited

U.S. PATENT DOCUMENTS

| | | | |
|---|---|---|---|
| 1,969,324 | 8/1934 | Poulter | 366/325 X |
| 1,982,610 | 11/1934 | Harris | 137/355.22 |
| 2,055,885 | 9/1936 | Weston | 264/31 |
| 2,176,891 | 10/1939 | Crom | 264/31 |
| 2,274,883 | 3/1942 | Brach | 52/110 |
| 2,286,904 | 6/1942 | Ewald | 222/530 X |
| 2,544,119 | 3/1951 | Wolfe | 138/138 |
| 2,692,092 | 10/1954 | Kinginger | 242/86.5 R |
| 2,930,199 | 3/1960 | Jarund . | |
| 2,985,404 | 5/1961 | Tashiro | 242/128 |
| 3,225,974 | 12/1965 | Athas | 222/529 |
| 3,273,813 | 9/1966 | George | 242/54 A |
| 3,379,019 | 4/1968 | Williams . | |
| 3,436,923 | 4/1969 | Lagerstrom . | |
| 3,520,725 | 7/1970 | Hamrick | 134/21 |
| 3,593,943 | 7/1971 | Collmann | 242/129 |
| 3,608,710 | 9/1971 | Pugh | 405/154 |
| 3,744,734 | 7/1973 | Lodato et al. | 242/129 |
| 3,809,333 | 5/1974 | Lefever | 242/129 |
| 3,815,845 | 6/1974 | Rygiol | 242/129 |
| 3,949,778 | 4/1976 | Woodford et al. | 137/355.16 |
| 3,999,391 | 12/1976 | Meredith . | |
| 4,040,329 | 8/1977 | Ljunberg . | |
| 4,066,093 | 1/1978 | Egerstrom | 137/355.12 X |
| 4,079,592 | 3/1978 | Eakin . | |
| 4,085,492 | 4/1978 | Stange . | |
| 4,116,368 | 9/1978 | Smith | 222/145 |
| 4,151,965 | 5/1979 | Manabe | 242/54 R |
| 4,253,813 | 3/1981 | Farrell | 425/90 |
| 4,278,363 | 7/1981 | Choi | 405/260 |
| 4,289,427 | 9/1981 | Rolston | 405/260 |
| 4,305,553 | 12/1981 | Coquerel | 242/86 |
| 4,344,553 | 8/1982 | Lesher et al. | 226/176 X |
| 4,453,679 | 6/1984 | Thuries et al. | 242/54 A |
| 4,461,600 | 7/1984 | Norkus et al. | 405/260 |
| 4,514,111 | 4/1985 | Issakainen . | |
| 4,589,803 | 5/1986 | Totten, III . | |
| 4,601,518 | 7/1986 | Lanéus . | |
| 4,615,234 | 10/1986 | Chevance et al. | 242/54 A X |
| 4,617,715 | 10/1986 | Koistinen et al. . | |
| 4,624,400 | 11/1986 | Zimmer | 226/188 |
| 4,643,619 | 2/1987 | Issakainen | 405/303 |

FOREIGN PATENT DOCUMENTS

| | | |
|---|---|---|
| 2526242 | 12/1976 | Fed. Rep. of Germany . |
| 1460292 | 10/1966 | France . |
| 1367404 | 9/1974 | United Kingdom .. |

*Primary Examiner*—Dennis L. Taylor

*Attorney, Agent, or Firm*—Birch, Stewart, Kolasch & Birch

[57] ABSTRACT

A device for storing a concrete feeding hose in a rock bolting device, comprising a reel for a hose, which reel is mounted rotatably on a supporter, and that end of the hose which is attached to the reel is connected to concrete feeding means. In order that the coiling device could be used for passing the hose into a drill hole and for drawing it out of the hole, the reel is surrounded by a ring-shaped supporting wall against which the hose is positioned when the reel is rotated in the uncoiling direction. An unrotative guiding means is provided beside the supporting wall so as to guide the hose out of the reel by the action of an axial expulsive force exerted on the hose due to the rotary movement of the reel.

7 Claims, 6 Drawing Figures

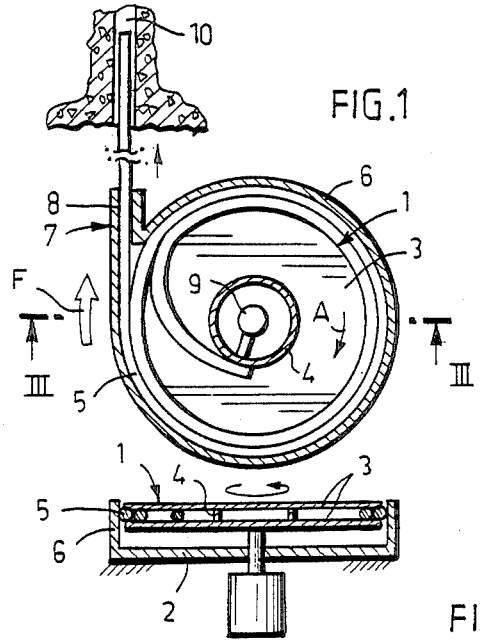
FIG.1
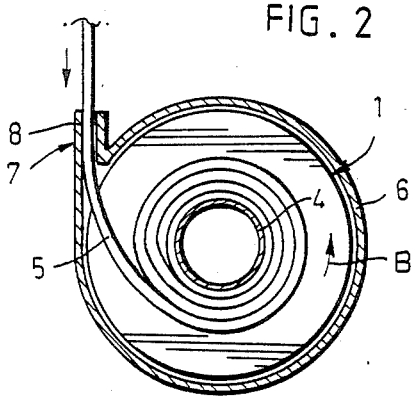
FIG. 2
FIG. 3
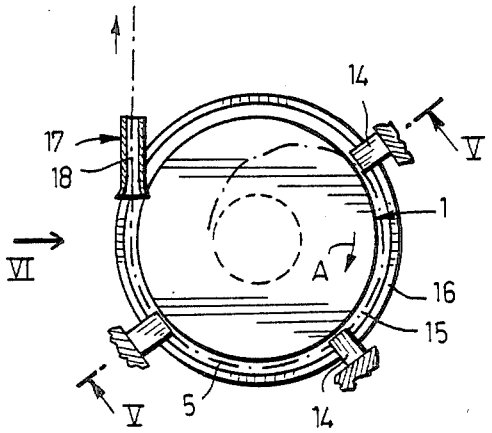
FIG. 4
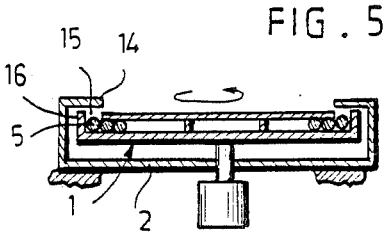
FIG. 5
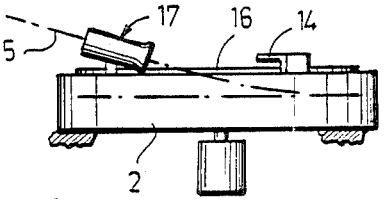
FIG. 6

APPARATUS FOR STORING A CONCRETE FEEDING HOSE IN A ROCK BOLTING DEVICE

FIELD OF THE INVENTION

This invention relates to a device for storing a concrete feeding hose in a rock bolting device, comprising a reel which is mounted rotatably on a supporter and on which a feeding hose is coiled when the hose is withdrawn from a drill hole and from which the feeding hose is uncoiled when the hose is passed into the drill hole, whereby that end of the hose which is attached to the reel is connected to concrete feeding means.

DESCRIPTION OF THE BACKGROUND ART

In rock bolting with grout feed a hole is first drilled in the rock by means of drilling equipment, whereafter concrete is fed into the hole by pushing a concrete feeding hose into the hole and by pumping concrete into the hole simultaneously as the hose is withdrawn from the hole. Finally, a rock bolt is pushed into the hole filled with concrete.

In mechanized rock bolting the concrete feeding hose is passed into the drill hole by means of a hose feeder which is attached to the drilling equipment and provided with tractive rollers. The hose is passed into the hole and drawn out therefrom by pressing the rollers against the hose and by rotating them.

When the holes to be bolted are long, and the hose is relatively long, the hose is wound into a coil on the bottom of the tunnel after it has been drawn out by the feeder, or it is coiled on a hose reel in proportion as the feeder draws it out of the hole. When the hose is fed into the hole, the feeder draws it into the hole from the bottom of the tunnel or from the hose reel.

Long hose coils lying on the bottom of the tunnel easily get stuck to stones when the bolting device is displaced. When the hose is fed into the drill hole, a slack hose may get stuck to the drilling equipment, or it may get tangled. When holes are drilled for the bolts, loose rocks dropping from the ceiling of the tunnel may damage the hose.

If a hose reel is used, it is necessary to provide the reel with its own rotation means besides the driving device of the feeder.

SUMMARY OF THE INVENTION

The object of the present invention is to provide a device which avoids the above disadvantages and enables the movements of the feeding hose to be controlled by means of a simpler structure. This object is achieved by means of a device according to the invention which is characterized in that the reel is surrounded by a ring-shaped supporting wall against which the feeding hose is positioned when the reel is rotated in the uncoiling direction (A) of the hose, and that an unrotative guiding means is provided beside the supporting wall to guide the hose pressed against the supporting wall out of the reel by the action of an expulsive force (F) exerted on the hose due to the rotary movement of the reel.

The invention is based on the idea that the hose reel is not only utilized for storing the hose, but it is also used as a means for passing the hose into the drill hole and for drawing it out therefrom. As an uncontrolled unwinding of the coiled hose is prevented, the hose is, due to the rotary movement of the reel, exposed to an expulsive force which acts in the direction of the hose so as to force it out through a single uncoiling point of the device. When the reel is rotated in the reverse direction, the feeding hose is drawn within the reel and, consequently, out of the drill hole so that the hose is coiled around the inner periphery of the reel. The supporting wall surrounding the reel restricts the unwinding of the hose within the reel when the reel is rotated in the uncoiling direction of the hose, thus effecting the expulsion effect mentioned above when the hose is pressed against the inner surface of the supporting wall.

By virtue of the invention no hose feeding rollers or other separate feeders are needed, so that the structure is simple and reliable in operation. No slack portions are formed in the hose to hamper the operation of the device. A great force can be exerted when the hose is drawn out of and pushed into the hole, because the force is not affected by the friction between separate feeding rollers and the hose.

The compression/buckling strength of the hose must be such that the hose resists the expulsive forces exerted thereon when the hose is pushed out from the reel.

BRIEF DESCRIPTION OF THE DRAWINGS

The invention will be described in more detail in the following with reference to the attached drawing which is given by way of illustration only, and thus is not limitative of the present invention, and wherein:

FIGS. 1 and 2 are schematic sectional views of one preferred embodiment of the device according to the invention when the hose is uncoiled from the reel and correspondingly when the hose is coiled on the reel;

FIG. 3 is an axial sectional view along the line III—III shown in FIG: 1;

FIG. 4 illustrates schematically another embodiment of the device in a partial sectional view;

FIG. 5 is a sectional view along the line V—V shown in FIG. 4; and

FIG. 6 is a side view of the device seen in the direction of the arrow VI.

DETAILED DESCRIPTION OF THE PREFERRED EMBODIMENTS

The device shown in FIGS. 1 to 3 of the drawing comprises a hose reel 1 which is rotatably mounted on a fixed supporter 2 and connected to a rotation motor. The reel is provided with two parallel flanges 3 and a central drum 4 interconnecting said flanges. The distance between the flanges corresponds to the diameter of a hose 5 to be coiled.

The reel is surrounded by a ring-shaped supporting wall 6 which is attached to the supporter at a distance from the outer periphery of the reel, which distance is smaller than the diameter of the hose. The supporting wall is provided with a guide means 7 attached tangentially to the inner surface thereof so as to form an uncoiling opening 8 slightly larger than the diameter of the hose.

The inner end of the hose is fastened on the central drum of the reel and connected to a concrete feeding means which are illustrated merely schematically by the reference numeral 9 in FIG. 1. Said means can be formed by a pump connected to a concrete vessel, and a feeding pipe connected between the pump and the central drum of the reel.

When the reel is rotated in the uncoiling direction A, as shown in FIG. 1, the hose is first uncoiled from around the central drum to some extent, whereafter it is positioned against the inner surface of the supporting wall. When the rotation of the reel is continued, the hose is exposed to an expulsive force F, and it finds its way out of the device into a hole 10 drilled in the rock through the opening 8 which is the only uncoiling point of the hose.

The feeding hose is made of a sufficiently rigid, firm, and slippery material so that it resists the expulsive force exerted thereon without buckling and without essentially changing the cross-sectional shape thereof, simultaneously as it slides easily along the inner surface of the supporting wall.

When the reel is rotated in the coiling direction B, as shown in FIG. 2, the hose is first wound tightly around the central drum of the reel, and is thereafter drawn out of the drill hole into the device due to the rotary movement of the reel.

The embodiment of the device shown in FIGS. 4 to 6 of the drawing differs from the preceding one mainly in that the supporting wall 16 is attached to one flange of the reel to rotate with the reel. A ring-shaped interspace 15 is formed between the supporting wall and the other flange of the reel, the width of the interspace being only slightly greater than the diameter of the hose.

A tubular guiding means 17 is attached to the fixed supporter of the device, and it has an uncoiling opening 18 corresponding to the hose. The guiding means is directed towards said interspace 15, and it is positioned immediately above it. The supporter is further provided with mutually spaced retaining plates 14 which overlap said interspace.

When the reel and the supporting wall thereof are rotated in the uncoiling direction A, the hose is again exposed to an expulsive force which pushes the hose out through the interspace into the uncoiling opening 18 and further therethrough. The retaining plates ensure that the hose rises up from the interspace only beside the guiding means. In this embodiment, the hose does not need to slide along the inner surface of the supporting wall.

The drawings and the description related thereto are only intended to illustrate the idea of the invention. In its details, the device according to the invention may vary within the scope of the claims. The reel can be smaller or the hose coiled thereon can be longer, if the hose is coiled on the reel e.g. in a spiral-like manner, with several windings superimposed. The hose must be supported in the sideward direction. The hose reel can also be similar to a cotton reel; i.e. there can be several parallel hose windings on the reel. The guiding means does not, either, necessarily need to be tubular, but it can be e.g. through-shaped.

What is claimed is:

1. A device for storing a concrete feeding hose in a rock bolting device, comprising a reel which is mounted rotatably on a supporter and on which a feeding hose is coiled when the hose is withdrawn from a drill hole and from which the feeding hose is uncoiled when the hose is passed into the drill hole, whereby that end of the hose which is attached to the reel is connected to concrete feeding means, wherein the reel being surrounded by a ring-shaped supporting wall against which the feeding hose is positioned when the reel is rotated in the uncoiling direction of the hose, and an unrotative guiding means being provided beside the supporting wall to guide the hose pressed against the supporting wall out of the reel by the action of an expulsive force exerted on the hose due to the rotary movement of the reel.

2. A device according to claim 1, wherein the supporting wall is unrotative with respect to the reel.

3. A device according to claim 3, wherein the guiding means is formed by an uncoiling opening provided in the supporting wall.

4. A device according to claim 1, wherein the supporting wall is fastened to rotate with the reel and the guiding means is unrotative with respect to the reel.

5. A device according to claim 4, wherein the guiding means is a fixed guide pipe which is provided with an uncoiling opening.

6. A device according to claim 1, wherein the feeding hose is sufficiently shape permanent to resist buckling when it is pushed, supported by the supporting wall, from the reel through the guiding means.

7. A device according to claim 1, wherein the inner end of the feeding hose is fastened on a drum formed by the inner wall of the reel and connected to the concrete feeding means.

* * * * *